US006202880B1

(12) United States Patent
Strube et al.

(10) Patent No.: US 6,202,880 B1
(45) Date of Patent: Mar. 20, 2001

(54) OPENABLE CAN END WITH SURPRISING OPENING PORTION

(75) Inventors: Lutz Strube, Königslutter (DE); Richard Reichinger, Liverpool (GB)

(73) Assignee: Schmalbach-Lubeca AG, Ratingen (DE)

( * ) Notice: Subject to any disclaimer, the term of this patent is extended or adjusted under 35 U.S.C. 154(b) by 0 days.

(21) Appl. No.: 09/043,685

(22) PCT Filed: Sep. 26, 1996

(86) PCT No.: PCT/DE96/01838

§ 371 Date: Jul. 6, 1998

§ 102(e) Date: Jul. 6, 1998

(87) PCT Pub. No.: WO97/11892

PCT Pub. Date: Apr. 3, 1997

(30) Foreign Application Priority Data

Sep. 26, 1995 (DE) ..... 195 35 827

(51) Int. Cl.[7] ..... B65D 17/34
(52) U.S. Cl. ..... 220/269; 220/906
(58) Field of Search ..... 220/265, 269, 220/270, 271, 272, 273, 712, 713, 906

(56) References Cited

U.S. PATENT DOCUMENTS 4,872,597 * 10/1989 Hanafusa ..... 220/269 X
5,494,184 * 2/1996 Noguchi et al. ..... 220/269
5,555,992 * 9/1996 Sedgeley ..... 220/270 X
5,695,085 * 12/1997 Hadener ..... 220/269

FOREIGN PATENT DOCUMENTS

472462 * 6/1974 (AU) ..... 220/270

* cited by examiner

*Primary Examiner*—Nathan J. Newhouse
(74) *Attorney, Agent, or Firm*—Duane, Morris & Heckscher LLP

(57) ABSTRACT

An openable can end for a beverage can of usual type, having a first tear-out portion which seems to be openable, when a lever-type tab is operated. A second tear-out portion is also provided beside or outside the first portion, wherein the second tear-out portion tears out (or breaks in) instead of the expected first tear-out portion. Thus, it is possible to surprise the user upon opening such a beverage can, without impairing the simple and reliable opening of the beverage can.

18 Claims, 3 Drawing Sheets

OPENABLE CAN END WITH SURPRISING OPENING PORTION

The invention relates to openable can ends for beverage cans, which cans are made of sheet material, and to the design of such can ends.

Such openable can ends are usually provided with a score line defining an area in the central panel, the score line serving for opening the can end by tearing and providing an opening for drinking or pouring out the content. The area in which said tear-out score line is located usually is stiffened by beads or ribs (line deformations) or a two-dimensional deformation. In the area of this stiffened tear-out portion a lever-type tab, mostly made of sheet material, is attached, mostly by means of a rivet. With said lever-type tab, the tear-out portion firstly is broken in and then at least partly torn out in order to provide an opening for pouring out or drinking.

It is the object of the invention to provide a simple means for surprising the user when he opens such a beverage can, without impairing the simple and reliable opening of the beverage can.

This problem is solved according to according to the invention.

A can having an end according to the invention can at first sight practically not be distinguished from a "usual can". Like a usual can, the central panel comprises an area stiffened by beads, ribs or deformations which may also have a kind of score line. The lever-type tab also is of usual form and is attached in a usual fashion by a rivet. When opening the can end, the user expects that the central panel breaks in, tears and continues to tear at the visible portion usually provided for opening and that, in this area, which is characterized by the stiffenings, the opening for the removal of the liquid is thereby provided. But in fact, the score line—if visible from outside in the stiffened area—is provided in such a way that it does not tear when opening, i.e. when actuating the lever-type tab. Instead, a score line for opening—which for the user is not or only hardly visible when the can is closed—is provided near or outside the usual and stiffened area, and also independent of it, so that, when opening the can with the lever-type tab, the opening for pouring out is provided at a portion completely different from the stiffened area.

In order to make the tear-out score line invisible or only hardly visible for the user, said score line may be provided at the backside or underneath the can end or it may be embossed/stamped from the backside. However, a score line may be located on the upper side or top surface in such a way that it is hidden or covered by said lever-type tab. Said score line may be covered either completely or partly. If it is partly covered—if the lever-type tab covers only a section of the score line—at least that portion of both score lines is covered—and thus hidden from the user's eye—which allows the initial break-in by its design. Therefore, it is not obvious which one of the two (or more) score lines starts to break in, although a number of possible opening portions are visible.

The invention may serve to provide a delimited opening portion, as it is usual with beverage cans, particularly having exactly the usual standard score line in the stiffened area. However, a score line provided underneath said lever-type tab may be positioned in the central panel in such a way that, when tearing out, this portion delimits a rupture tongue with which and with a score line extending along the edge of the end, the central panel may be torn out as a whole to provide an opening. In this case, it is a full opening end.

The torn-out can end portion may comprise a mark (symbol or pattern; on the backside), which mark may also be well-hidden on the backside of the tab. Said mark should only be visible when the can has been opened at a surprising portion. Said surprising portion may be a tear-out opening segment, thereby being expressed that a complete portion of the can end is torn off in outward direction, no longer being connected with the remaining central panel. The segment inviting to be opened, which shall be caused to pivot inwards like a lever by means of the lever-type tab and which surprisingly does not open, remains a standard opening segment pivoting into the can (in direction of the backside of the end). In case of those can ends, for which the surprise is not intended, which therefore should open like a usual can end, the alleged pivoting (virtual) opening segment is a real opening segment, the surprising opening segment not being torn out. As distinguished from the tear-out (surprising) opening segment, the pivoting opening segment works with an initial break-in portion, where the ends of the score line are positioned the most closely together, where the initial break-in portion is formed by the shearing force of the opening lever. The continuous tearing of the standard score line causes the opening portion to pivot inwards. In case of the intended surprise, for example in case of only a few cans out of a large charge, the break-in process is initiated by tearing out. Correspondingly, this is to express, that in general terminology, opening by tearing ("Aufreiβen") comprises breaking in ("Einbrechen") as well as completely tearing out ("Ausreiβen"), breaking in comprising the component of a movement in inward direction and tearing out the component by a movement in an outward direction.

Further symbols or patterns may be incorporated in the end, to appear only when the closed can is pressurized. These non-tearing "score lines" may be applied by laser.

In an embodiment having two opening portions visible to the user from outside, that portion of said several portions which is located under the lever-type tab defines which one of them breaks in and continues to tear when the lever-type tab is actuated. Said covered portions are advantageously provided in the attachment area (at the rivet) of the lever-type tab, where the lever-type tab has the largest coherent surface area and where it is least moveable in upward direction (to avoid "kibitzing" of curious people).

In an embodiment where there is provided a greater number of opening portions than ends are present at the lever-type tab (on both sides of the rivet), the lever-type tab is provided pivotably (around the rivet), so that more than two opening segments may be achieved. They may consist of pairs of pivoting segments and tear-out segments being distributed symmetrically around the center of the central panel. For selecting the desired pair, the lever-type tab is turned like a wheel of fortune.

The portion being designed as surprising opening portion may have the shape of a bottle, other shapes also being definable by score lines (stars, cricket sticks, hockey sticks), particularly sports motifs. If a bottle shape is selected to constitute the tear-out segment, the shape of the bottle may approach a bottle shape well-known to the user, with which bottle shape the user associates the content of the sheet can. Nowadays, common beverages are bound to common bottle shapes, and the user recognizes these bottle shapes without particular trade names having to be indicated. These bottle shapes may be attributed to the surprising tear-out portions in case the beverage contained in the metal can corresponds to the beverage usually sold under and with this bottle shape.

The invention is described in detail on the basis of schematic drawings with several embodiments.

Figure 2:
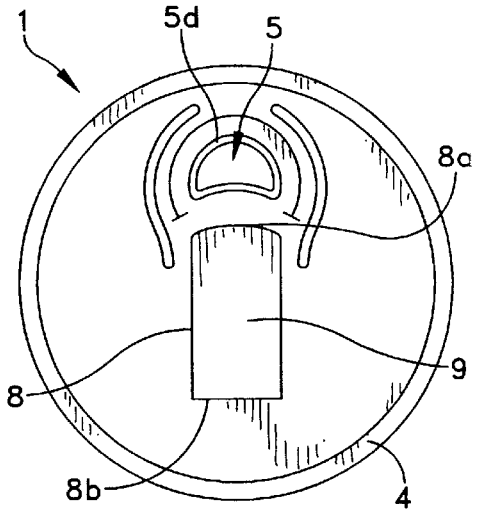
FIG. 2 shows the can end 1 according to FIG. 1 from the backside with opened portion 9 for pouring out.
Figure 3:
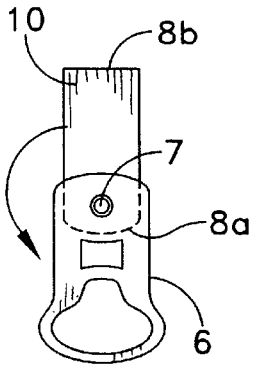
Figure 3A:
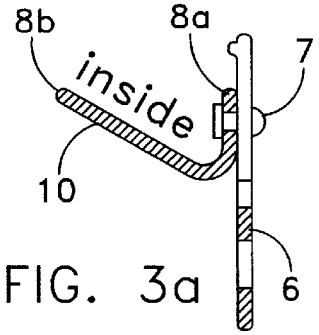
Figure 3B:
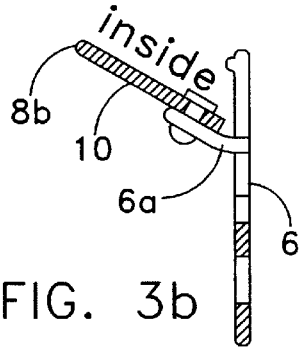

FIG. 3,

FIG. 3*a*,

FIG. 3*b* are a backside and two side views of a portion 10 according to FIG. 2, torn out of a can end 1 with a lever-type tab 6.

Figure 1:
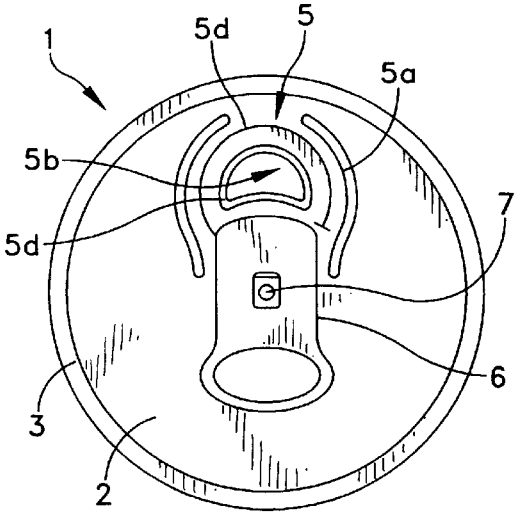
FIG. 1 is a view from above of an openable can end 1 according to the invention.
Figure 4:
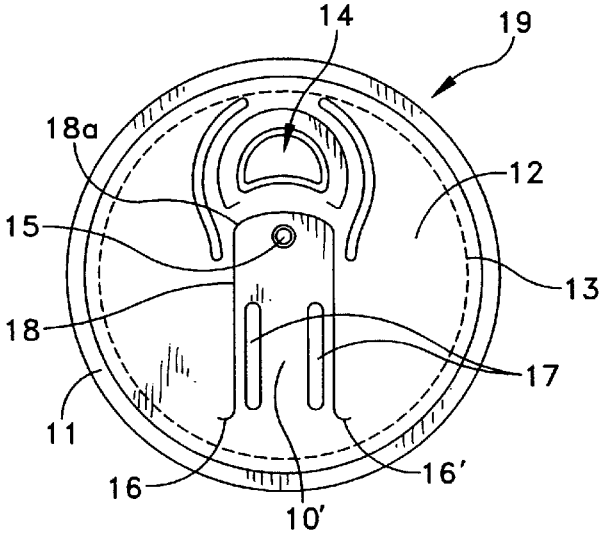

FIG. 4 shows a modified embodiment 19 in a view similar to FIG. 1, the lever-type tab being omitted for the reason of distinctness.

Figure 5A:
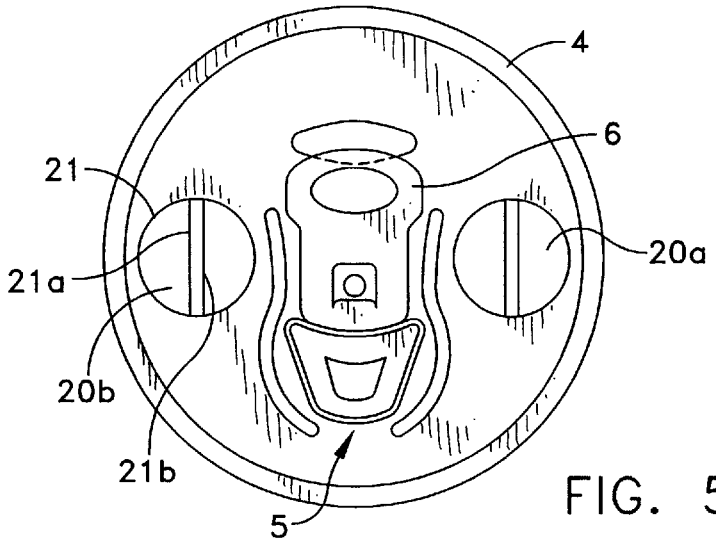
Figure 5B:
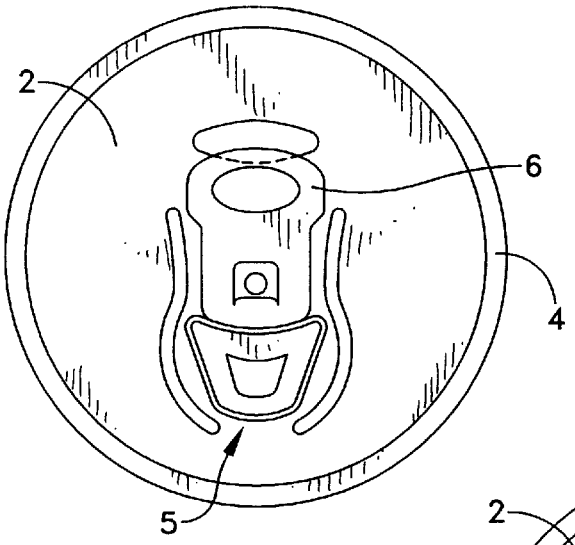
Figure 5C:
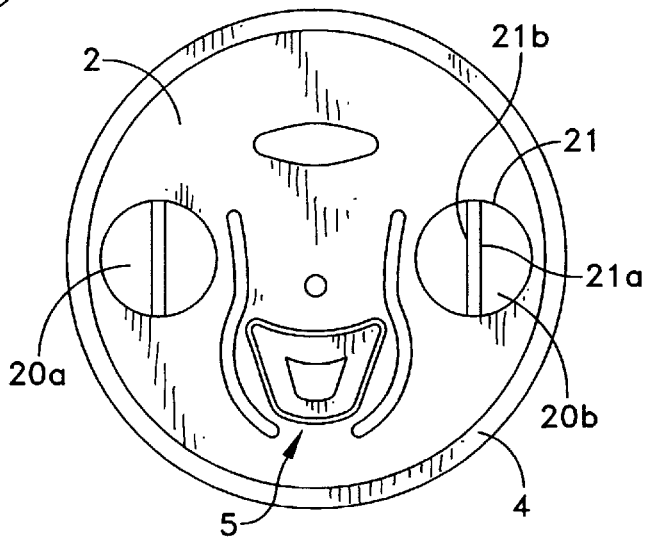

FIG. 5*a*,

FIG. 5*b*,

FIG. 5*c* give examples of non-tearing score lines 21*a*, 21*b*,21 incorporated by laser on the backside and causing symbols or marks 20*a*,20*b* on the top after pressure is applied.

Figure 6A:
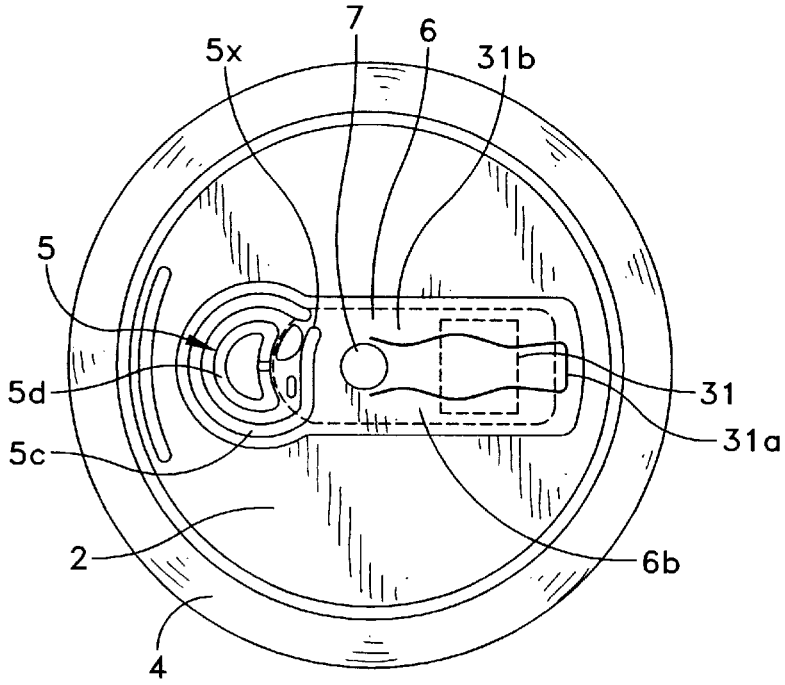
Figure 6B:
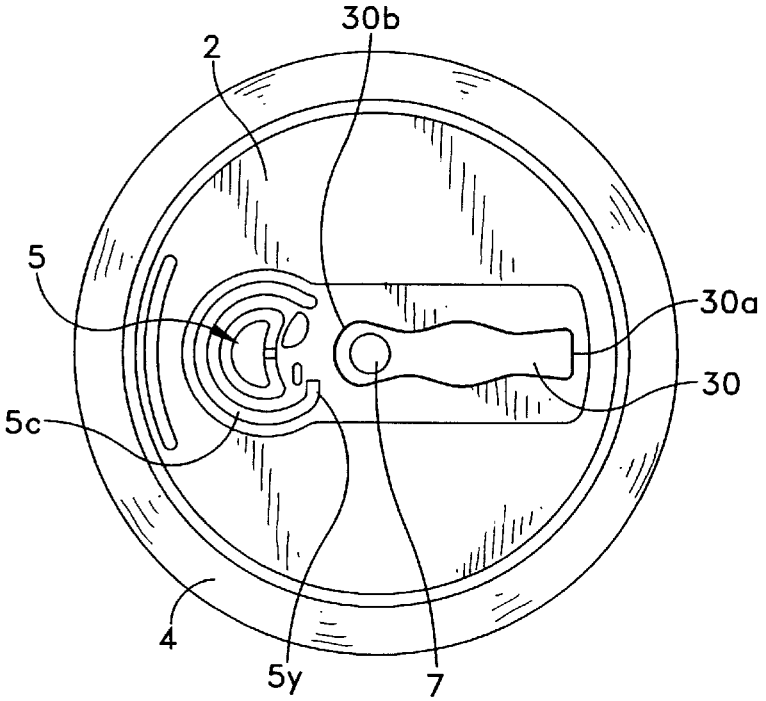

FIG. 6*a*,

FIG. 6*b* give examples of tear-out portions 30,31 with a new geometrical shape.

The openable can ends are preferably made of sheet material.

The can end 1 according to FIGS. 1 and 2 comprises an area 5 in its central panel 2, which is circumscribed by an edge 3 of the can end, which area 5 is stiffened by usual ribs 5*a* or beads 5*d* or two-dimensional deformation(s) 5*b*. As shown, a sort of score line 5*c* may also be visible in this area. However, this score line may also be missing. Said area 5 corresponds to a usual stiffened area of usual openable can ends, so that the user of a can, which is closed with such a can end, has to and will suppose that—when opening it—the sheet material tears out along line 5*c* in a usual way and opens the drinking or pouring portion.

As usual, a lever-type tab 6 is attached to the central panel 2, preferably by a rivet 7, and close to said area 5 and preferably in a relative position with regard to said area 5, as this is usual for usual beverage can ends.

The view and the structure of said can end I in the top view according to FIG. 1 may deviate from the illustrated form insofar as the outer appearance corresponds to that of a usual openable can end.

FIG. 2 is a backside view of the can end, a sealing compound 4 being incorporated in the edge 3 of the can end. Again the stiffened area 5 is visible. Outside this area and independent of it, a score line 8 is provided which may be broken in at section 8*a* and further torn out to provide an opening 9 in the central panel 2. As a comparison with FIG. 1 shows, said score line normally is covered from outside by said lever-type tab 6. However, it may also be incorporated in the sheet material from the backside, so that—independently of being covered by said lever-type tab 6—it is not or not easily visible from outside.

FIG. 2 shows the can end 1 after tearing out the sheet strip segment 10 delimited by said score line 8, which sheet segment being durably attached to said tab 6 by said rivet 7. The score line 8 may also be arranged in such a way that it is interrupted in the area close to the edge of the can end, so that, also after opening, the strip segment 10 remains definitely attached to said can end 1.

The purpose and the function is to surprise the user when opening a can being equipped with the new can end with regard to the position and the shape of the opening portion being provided. This surprising effect may for example be used to designate winners in a sales competition by providing for example a corresponding mark (first price, second price) on the backside of the sheet segment 10, which mark becomes visible (only) after opening the can end. Winners are surprised by the unexpected opening fashion, losers do not realize anything and open the usual can.

FIG. 3, FIG. 3*a* and FIG. 3*b* are a top view and two side views of torn-out opening segments corresponding to the opening segment 10 of FIG. 2. On said opening segment 10, the inner surface area is marked, where a mark informing and legitimating a winner in the above described scope may be provided. The initial tear-out portion, at which the tear-out process starts, is designated with reference numeral 8*a* and corresponds to the semicircular portion of FIG. 2. By actuating said lever-type tab 6, which has to be capable of causing the pivoting process of the usual opening portion 5 and which simultaneously has to take along the tear-out portion 10 of those can ends which are intended to open surprisingly, the tear-out portion 10 is strongly bent when the can is opened, as illustrated by FIG. 3*a*. In an inner recess of said tab 6 according to FIG. 3*b*, a pivoting tab 6*a* may be provided to stop said bend, so that said tear-out portion 10 is almost not bent. In all FIGS. 3, said rivet 7, with which said tear-out portion 10 is—according to FIG. 3*a*—either directly attached to said tab 6 or fixed at said tab 6 via said pivoting tab 6*a*, is clearly visible.

The end of said tear-out segment 10 is a separable score line with its portion 8*b*, which score line may have a substantially straight extension in order to be easily separable.

FIG. 4 shows a further embodiment of an openable can end 10 being provided as a full opening end. The end again has a stiffened area 14 in the central panel 12 surrounded by the edge of the can, which area 14 corresponds to area 5 as shown in FIG. 1. Outside and independent of said area 14, a score line 18 is provided in the central panel, which score line starts to break in at 18*a* with the aid of a lever-type tab being omitted in FIG. 4 for the reason of simplification. It is provided outside said area 14 and independently thereof with regard to its opening function, e. g. stamped in the backside of the end, terminating at 16 and 16'. Additionally, a further tear-out score line 13 is provided which is located parallel and close to the edge 11 of the can end. Firstly, the score line 18 may be opened with the lever-type tab attached to rivet 15 to form an opening segment 10' in strip form stiffened by ribs 17, which opening strip then serves as opening tab for opening said score line 13, in order to separate the whole central panel 12 from the can to open it.

It is again emphasized that the form of the visibly stiffened area 5 or 14 and the type of stiffening may deviate from the form and arrangement shown. The stiffened area should be provided in the respective usual way. The same applies to the lever-type tab and its attachment as well as its relative attachment with regard to the stiffened area. Before opening a can being equipped with a can end according to the invention, the user should have the impression to open a usual can at the usual portion. Thus, the surprising effect is achieved, when the can opens—to the complete surprise of the user—at a different portion.

FIGS. 5*a* to 5*c* show can ends having a pattern incorporated on their backside which appears on the top side of the end, when the can (covered by the end) is pressurized. The manufacturing is illustrated in three steps. According to FIG. 5*c*, the patterns 20*a*,20*b* are applied by laser on the backside of the central panel 2. The symbols are provided as circular designs 21 with a pair of stripes 21*a*,21*b* inside. From the top, the ends have usual appearance, the patterns 20*a*,20*b* incorporated from the backside not being visible, as illustrated by FIG. 5*b*. FIG. 5*a* again shows the top view of an end as pressurized; the patterns 20*a*,20*b* appear as if they had been incorporated in the end attached to the filled can.

The "score lines" 21,21*a*,21*b* defining the patterns 20*a*, 20*b* are only visible, not openable and may not be opened. With regard to the patterns 21,21*a* and 21*b*, the term "score line" is to be understood such that it does not have the usual function of score lines, but serves for forming marks, symbols and ornaments on the top side of the can in a manner favorable for production. In contrast to said "score lines", the score lines circumscribing the real opening section in the sense described at the beginning have a greater depth, the remaining thickness of the sheet material therefore being less. The score lines which are only optically visible and which are not intended to tear may leave a considerably larger sheet thickness, thus having a smaller depth than the score lines really opening.

FIGS. 6*a* and 6*b* show an embodiment of the opening portion 30,31 corresponding to the opening portion 10 of FIG. 2 with regard to its function. In this embodiment, said opening portions have the shape of a usual bottle, their section close to the rivet defining whether the bottle shape really opens when actuating the lever-type tab 6 or whether it remains closed to open instead the pivoting section 5 along the score line 5*c* with the initial break-in section 5*x*. The section determining which of the two opening portions really open is covered in the section close to the rivet by said lever-type tab 6 and indicated by a broken line in FIG. 6*a*. Outside said section, the opening segments are visible, the bottle-shape opening segment 31 as well as the usual opening portion 5.

In FIG. 6*a*, the usual opening portion opens by starting to break in at the end 5*x* of the real opening score line 5*c*. The two ends of the score line are close to each other. The two ends of the only visible score line 31*a* defining the second opening segment 31 are clearly spaced apart in section 31*b* and do not close, do not even approach each other.

In the embodiment of FIG. 6*b*, the tear-out portion 30 is the opening section being provided with a real tear-out score line 30*a* which is opened by the lever-type tab 6—which is not illustrated in this Figure. The bottle shape of the score line 30*a* closes over the initial tear-out section 30*b* around the rivet 7. Instead, the usual score line 5*c* according to FIG. 6*a* is not provided with an end 5*x*, but terminates before at 5*y*, so that the opening section 5 does not open when actuating said lever-type tab 6.

The respective determinating section of the score line on either side of said rivet 7, which section determines which one of the two opening sections really opens when actuating said lever-type tab, is covered by the two-dimensional part 6*b* of said lever-type tab 6. Therefore, it is not visible to the user, even if the user can easily recognize the two opening portions 30 and 5 or 31 and 5 from outside. Only the sections of the score line and of the dummy score line, respectively, defining the initial break-in section or the initial tear-out section with regard to their opening function, are hidden.

What is claimed is:

1. Openable can end made of sheet material for beverage cans, comprising a central panel, a first area comprising beads or ribs and visually appearing as a tear-out portion for opening a segment of limited size of the can end, and a lever-type tab which tab is mounted close to said first area on the central panel, said first area not capable of being opened by operation of said lever-type tab; a second area comprising a real tearable score line defining an opening segment of limited size, said second area being located outside said first area and being at least partially concealed, said opening segment being openable by operation of said lever-type tab.

2. Openable can end according to claim 1, wherein said real tearable score line for opening said opening segment is located along and close to a rim of the can end.

3. Openable can end according to claim 2, wherein said real tearable score line for opening said opening segment is concealed at least partly by said lever-type tab.

4. Openable can end according to claim 3, wherein said real tearable score line is provided below said tab and delimits a rupture tongue in said central panel as said opening segment, said tongue being adapted to tear out of the central panel, and wherein an additional score line, extending along the rim of the can end, is provided for tearing out the central panel.

5. Openable can end according to claim 1, wherein said real tearable score line for opening said opening portion is provided on an inside surface of the can end.

6. Openable can end for a beverage can comprising a central panel and a lever type tab attached to said panel, and having:

(a) a first portion having at most an incomplete score line, said first portion not capable of being opened by operation of said lever-type tab; and (b) a second portion located beside or outside said first portion, said second portion having a segment openable by operation of said lever-type tab, wherein said segment opens unexpectedly by operation of said lever type tab instead of the first portion, as expected.

7. Openable can end according to claim 6, wherein the second portion is at least partly visually hidden, so that a portion which causes or seems to cause the opening may at most be only hardly perceived from outside the can end.

8. Openable can end according to claim 6, wherein a mark is provided on a side of the tab facing the can end or on a backside or inner side of the second tear-out portion.

9. Openable can end according to claim 6, wherein said first portion comprises an apparently inwardly pivotable opening segment and the second portion comprises a tear-out opening segment having a score line entirely surrounding a rivet of said lever-type tab for making the second portion a real tear-out portion.

10. Openable can end according to claim 9 wherein further score lines are located on an inner side of the central panel, defining at least one of patterns and symbols on a top or outer side of the central panel, said further score lines however not being tearable.

11. Openable can end according to claim 10, wherein said further lines are not visible from outside if no pressure is affecting the can end.

12. Openable can end according to claim 11, wherein said further lines are applied by laser.

13. Openable can end according to claim 6, wherein a complete and said incomplete score lines are at least partly covered by the tab.

14. Openable can end made of sheet material according to claim 6, wherein the second portion is substantially located under said lever-type tab, and has a shape of at least one of a sports motif and a bottle.

15. Openable can end according to claim 14, wherein said second opening portion has said bottle shape and the bottle shape is selected to identify a nature of content of the beverage can closed with said can end.

16. Openable can end made of sheet material for beverage cans, having a lever-type tab and a central panel provided with two spaced apart independent portions, one of said independent portions having a complete score line, the other of said independent portions having at most an incomplete score line, the portion having a complete score line being openable by operation of said lever-type tab, only one of which is openable by the tab tearing and then is continuously tearable further along the complete score line whereby initial sections of said two score lines, one of which is provided to initially break in by the action of the tab and the other one of which is adapted not to initially break in by the action of the tab, are covered by said tab.

17. Can end according to claim 16, wherein an initial section of the at most incomplete score line and an initial section of the complete score line are located next to an attachment point of said lever-type tab.

18. Can end according to claim 16, wherein said at most incomplete score line is an at least partly visible line with two ends and having at least one of a reduced score depth, and one end of said line not approaching the other end of said line, to substantially avoid opening of the first portion having the incomplete score line by operation of the lever-type tab.

* * * * *